US006083079A

United States Patent [19]

Pearson

[11] Patent Number: 6,083,079

[45] Date of Patent: Jul. 4, 2000

[54] WIRELESS ERGONOMIC SUPPORT BRASSIERE

[76] Inventor: Cynthia K. Pearson, 211 Riverbottom Dr., Sevierville, Tenn. 37862

[21] Appl. No.: 09/092,274

[22] Filed: Jun. 5, 1998

[51] Int. Cl.[7] ..... A41C 3/00

[52] U.S. Cl. ..... 450/1; 450/59; 450/36

[58] Field of Search ..... 450/1, 31–32, 450/36, 37, 59, 60, 62, 64

[56] References Cited

U.S. PATENT DOCUMENTS

| | | |
|---|---|---|
| 2,533,060 | 12/1950 | Silvain . |
| 2,607,038 | 8/1952 | Spare . |
| 2,965,103 | 12/1960 | Blair . |
| 3,002,516 | 10/1961 | Cole . |
| 3,459,190 | 8/1969 | Frischer et al. . |
| 3,952,752 | 4/1976 | Huttle, Jr. . |
| 4,143,662 | 3/1979 | Fisher . |
| 4,350,162 | 9/1982 | Kearton et al. . |
| 4,413,625 | 11/1983 | Footer . |
| 4,550,734 | 11/1985 | Porco . |
| 4,633,876 | 1/1987 | Scullin . |
| 4,655,224 | 4/1987 | Stern et al. . |
| 5,167,566 | 12/1992 | Novitsky et al. . |
| 5,171,182 | 12/1992 | Heinen . |
| 5,472,366 | 12/1995 | Moore . |
| 5,660,577 | 8/1997 | Modena . |

OTHER PUBLICATIONS

Motherwear, *Parenting from the Heart, Motherwear's Magazine for Nurturing Families*, No. 33, Mar. 1997, pp. 31–35, and the back cover page.

*Primary Examiner*—Gloria M. Hale
*Attorney, Agent, or Firm*—Luedeka, Neely & Graham PC

[57] ABSTRACT

The invention described in the specification relates to an ergonomically designed support garment for use in supporting the breast of a woman. The support garment contains an inverted Y-shaped portion having an apex, a lateral side and a medial side attached to a support means having a bottom portion, a lateral arm and a medial arm for uplifting support of a woman's breast wherein the lateral side of the Y-shaped portion is connected to the lateral arm at an angle ranging from about 120 to about 140 degrees therebetween and the medial side is attached to the medial arm at an angle ranging from about 65 to about 85 degrees therebetween. Because of the design of the Y-shaped portion and the connection angle to the support means, a bra containing Y-shaped portion and support means provides enhanced support of a woman's breast for a variety of activities without the need for wires or stiffeners which are conventionally used to support woman's breast.

22 Claims, 6 Drawing Sheets

WIRELESS ERGONOMIC SUPPORT BRASSIERE

FIELD OF INVENTION

The invention relates generally to foundation garments, and particularly to garments for supporting breasts.

BACKGROUND AND SUMMARY OF THE INVENTION

Historically, women's clothing styles have fluctuated dramatically over the years. Throughout the ages, for different sociological and cultural reasons, women have either emphasized or de-emphasized their chests. For example, the Minoan women who lived on the Isle of Crete in about 2500 B.C., actually wore bra-like contraptions which lifted their bare breasts out of their clothes. Just a few centuries later, Roman women tightly bound their chests with bands of cloth in order to reduce their breast size.

Despite the continuous variations in apparel styes, the bra as we recognize it today is a relatively recent addition to the feminine wardrobe. Before the early 1900s, if women wore any type of foundation garment at all, they either bound their chests or wore a chemise (a loose slip-like undershirt). As another alternative, if the style called for a more defined figure, women tightly laced themselves into corsets. The corset encased a woman from about her clavicles to her hips. Thin strips of whale bone ensured that the woman's contours were confined to fashionably acceptable dimensions. However, the corsets were extremely uncomfortable and considerably restricted a woman's movement, even reducing her ability to breathe deeply.

As outerwear styles began changing at the turn of the century, so did foundation garments. A new vogue for sheer romantic evening gowns became haute couture. Chemises and corsets were too bulky and unsightly to wear underneath the modern diaphanous style gowns. In addition, women's blouses were introduced as an acceptable form of fashionable casual dress. Blouses, which did not inhibit a woman's movement as much as previous fashion styles, allowed a woman to become more active, both at work and in recreational pursuits. Chemises and corsets were too binding and restricted a woman's freedom of movement, negating all the advantages of the new blouses.

As a result, bras which were not as cumbersome or restrictive as corsets yet still emphasized the female chest, were developed and began to become popular foundation garments in the early 1900s.

Even in the relatively few decades that bras have been available, their style and purpose have fluctuated considerably. For example, the bras developed and worn in the 1920s did not emphasize a woman's breasts. Flappers, as trendy young women of the day were called, wanted to achieve a long, flat silhouette, without any unsightly bulges at the chest level. Thus, bras in the 1920s were very tight and flattened the chest.

Later styles, beginning in the 1930s again emphasized the female chest. Various devices were developed to lift and shape women's breasts into a wide range of fashionably acceptable forms, from high, pointed "bullets" to softly rounded "cups". Many of these devices focused less on comfort than on achieving a fashionably desirable hourglass figure.

In order to shape and support, bras since the 1930s have incorporated all types of materials, no less binding and uncomfortable than the whale bones found in the corsets of a century ago. Thin wires or hard plastics were incorporated into the bra cups in order to force the breast into the currently acceptable shape. Hard, substantially rigid materials were also used to mold the breast into a fashionably accepted form.

Women's clothing fashions continue to evolve, along with their role in society. Presently, although women have achieved greater freedoms in areas such as education, careers and politics, they continue to be uncomfortably bound in bras which painfully force their breasts into fashion-driven shapes using wires and other stiff, unyielding materials.

The bra industry has not kept up with increasing changes in women's fashions and women's expanding role in society. Women are no longer restricted to focusing on one role at a time. That is, women are professionals, athletes and mothers all at the same time. Unfortunately, a single foundation garment is not available to support all these activities. Women have been required to purchase different types of foundation garments, each bra being specifically designed for a particular activity. For example, bras are designed and sold for defining (and sometimes exaggerating) breasts and for providing support for everyday activities. Such bras are usually worn underneath casual clothing, business suits or formal attire. These bras typically support the breast in a cup shape and are considered to increase a woman's attractiveness. Although, these bras contain uncomfortable underwires or other unyielding support structures, they do not provide support for exercising activities.

Other bras have been developed to provide extra support during highly physical activities such as exercising and participation in recreational sports. Typically these bras are made to tightly bind a woman's breasts to her chest so that they do not move during strenuous physical activity. It is important for a woman to have her breasts stabilized during physical activity so that she will have greater freedom of movement and to prevent injury to her breasts, such as by stretching internal collagen support fibers. The so called "sport" bras provide such support. However, because sport bras flatten the breasts to a woman's chest, they are not considered to particularly enhance a woman's appearance and are thus not considered appropriate as foundation garments to be worn underneath clothing such as business suits and formal attire. Additionally, most "sport" bras are designed to stabilize a women's breasts during activities which occur on dry land, such as jogging or aerobics. Such bras are less suitable for use in water sport activities.

In addition, a woman requires a specially designed bra when she is nursing to provide support for the increased breast size of a nursing woman and to allow quick and easy access to her breast without having to completely remove her bra. Typically nursing bras are provided with a detachable cup. The cup of the bra can be separated from the rest of the bra, allowing access to the nipple without removal of the entire bra. This is usually accomplished by providing a cup which is permanently attached only to either the bottom or the side of the bra and providing hook-and-loop or a hook-and-eye closure device on the cup to secure the cup to the bra.

Accordingly, it is an object of the present invention to provide an ergonomic foundation garment which is comfortable.

Another object of the invention to provide a foundation garment which supports breasts without the use of underwires or other substantially unyielding structures.

A further object of the invention is to provide a foundation garment which supports a woman's breasts in a gentle yet substantially supportive manner.

An additional object of the invention is to provide a foundation garment which defines and supports a woman's breasts, which can be worn underneath garments such as casual clothing, business suits and formal attire.

Yet an additional object of the invention is to provide a foundation garment which can be used as a bathing suit top.

Another object of the invention is to provide a foundation garment which stabilizes a woman's breasts, such as during physical activity, without tightly binding the breasts to the chest.

Yet a further object of the invention is to provide an improved nursing bra.

Yet another object of the invention is to provide a foundation garment which can be worn for a wide variety of activities.

SUMMARY OF THE INVENTION

The above and other needs are met by a wireless ergonomic support brassiere (bra) which simultaneously provides comfortable support for a woman's breasts during a variety of activities. The bra includes padded shapers for lifting a breast, each shaper being in the form of an inverted "Y" having a medial leg portion and a lateral leg portion and a shoulder portion at the apex of the inverted "Y" wherein the medial leg portion and the lateral leg portion of each shaper extend downward from the apex on either side of the breast of a wearer to provide lifting support from above the breast when the bra is being used. Padded, partial cup portions are included, each having a lateral arm portion attached to the lateral leg portion and a medial arm portion attached to the medial leg portion of the shapers thereby forming a central cup portion between the lateral and medial arm portions of the cup portions for supporting the breast from below the breast during use. Each lateral arm portion is attached along at least a portion of its length to the lateral leg portion and the medial arm portion is attached along at least a portion of its length to the medial leg portion. A middle portion is connected between the cup portions to the medial arm portions of the cup portions. The bra also includes a torso portion having a bottom, side portions and a back portion wherein the side portions are connected to the lateral arm portions of the cup portions and the back portion extends from between the side portions around a torso of the wearer, the back portion having a top edge. Shoulder straps are connected to the top edge of the back portion wherein the straps extend over a wearer's shoulders when the bra is in use and the straps are connected to the shoulder portions of the shapers.

A particular advantage of the bra is that it is made without underwires or other stiff, unyielding materials. Thus the bra does not bind, bruise, chafe or cut like conventional bras which contain underwires or other stiff unyielding materials. In addition, the bra is ergonomically designed so that the bra structure itself provides gentle support. The padded shapers which are made from a soft flexible material provide a lifting support from above the breast. Preferably, the legs and shoulder strap are all cut from a single piece of material, such that there are no seams to chafe the wearer.

Another feature of the invention is that the shoulder strap is relatively non-elastic. That is the shoulder straps are not stretchable, such that a constant lifting force is applied to the breast while the partial cup portions provide a foundation support from below the breast. The medial and lateral arms of the partial cup are attached along at least a portion of their length to the medial and lateral legs of the padded shapers. The lateral arm of the partial cup is specifically angled such that when it is attached to the lateral leg of the padded shaper, the greatest amount of support is provided.

Variations may be incorporated into the bra, without deviating from the invention. For example, an elastic band may be provided around the bottom of the partial cups and the top and bottom of the torso and back portions of the bra to prevent twisting of the bra. Such elastic band does not provide any significant support function.

In another embodiment, the bra may have an outer cup portion. The outer cup portion is made from soft, stretchable fabric, such as soft, cotton jersey or stretch lace material or other materials which are soft and expandable. The outer cup also does not provide any significant support function. The outer cup portion may be basically triangular in shape, having a top, a bottom, a lateral side and a medial side. The outer cup can be completely attached to the padded shaper and partial cup portions of the bra such that the outer cup portion is not easily detachable.

Alternatively, the outer cup portion can be attached to only a portion of the padded shaper or partial cup, so that the outer cup is partially detachable, in order to provide easy access to the breast. By only partially attaching the outer cup, the bra can be used as a nursing bra. In one nursing bra embodiment, the outer cup may be attached only at the bottom of the partial cup by a seam. Standard closure means may be provided at the apex of the padded shaper and the top of the outer cup to removably attach the outer cup to the bra. Standard closure means can include hoop-and-loop material, hook-and-eye closures, snaps and other standard closure means. In this embodiment, the outer cup can be detached from the apex of the padded shaper and folded down to expose the nipple.

In another embodiment, the lateral side of the outer cup is attached to the lateral leg of the padded shaper. In this embodiment, the bottom of the outer cup is at least partially attached to the lateral arm portion of the partial cup and the top of the outer cup is at least partially attached to the apex of the padded shaper. The medial side of the outer cup is not attached. Because the material from which the outer cup is made is soft and stretchable, the outer cup can be stretched to one side of the breast, providing access to the nipple. The outer cup may contain a thin elastic material along its unattached edges to prevent bunching and twisting of the outer cup. The elastic material is relatively ineffective for support purposes.

An added benefit of the bra when it is used as a nursing bra is that the combination of the padded shapers and the partial cups provide enough support to the breast so that the nursing woman does not have to use her hands to support her breast while nursing. Thus, the woman has both hands free to work with her infant.

It is not necessary for the bra to include an outer cup portion. The combination of the padded shapers and the partial cups provide the desired support. Furthermore, for some embodiments, it is preferable to not include any type of outer cup portion in order to provide a more sensual appearance.

The bra can be configured into additional embodiments without detracting from its value as a general use bra or a nursing bra. For example, the bra can have fasteners located on the back portions of the torso portion. The fasteners can be standard fasteners such as hook-and-eye fasteners and equivalents thereof, which allows for a customized fit around the torso of the wearer. In addition, the shoulder straps can contain adjustable straps with a standard adjuster means which allows for adjustment of the length of the shoulder strap, again to customize the fit of the bra to the wearer.

In yet another embodiment, the shoulder strap can contain a short portion of elastic material between the end of the shoulder strap and the top of the back portion. The inclusion of the short piece of elastic allows for minute adjustment in the length of the shoulder strap. These minute adjustments in the length of the shoulder strap allow the wearer to assume varied postures, without having to adjust the shoulder strap for optimal lifting support and comfort. These minute adjustments are particularly important when a woman is engaged in strenuous physical activity, such that she is constantly moving her arms, shoulders and torso.

The combination of the padded shapers and the partial cups provide sufficient support for stabilizing a woman's breasts during strenuous physical activity. Also, because the bra does not contain any underwires or other stiffening materials, the bra is comfortable to wear during all types of physical activities such as exercising or participating in sports. The bra can function not only to provide support during traditional land activities such as jogging and aerobics, but can also function as a bathing suit top for tanning or for water sports such as swimming and water skiing. Because the bra supports and stabilizes the breasts without flattening the breasts to a woman's chest, the bra is also appropriate to wear with any type of clothing including casual clothing, business suits and formal attire.

In still an another embodiment, the shoulder straps can be integrated into the torso portion of the bra. That is, the side portions, the shoulder straps and the back portion of the bra are cut from a single piece of material. In this embodiment, the integrated portions of the bra can be made from a suitable soft fabric, such as cotton or other materials known in the trade. Elastic may be included along the top of the torso region to provide for gentle expansion and minute adjustment of the bra. The elastic does not provide any significant support function. In this embodiment, the bra is either slipped over the head to take it on and off or the bra can have standard closures in the middle portion of the front of the bra such as hook-and-eye, snaps or equivalents thereof.

BRIEF DESCRIPTION OF THE DRAWINGS

Further advantages of the invention will become apparent by reference to the detailed description of preferred embodiments when considered in conjunction with the figures, which are not to scale, wherein like reference numbers indicate like elements through the several views, and wherein.

DETAILED DESCRIPTION OF THE DRAWINGS

Figure 1:
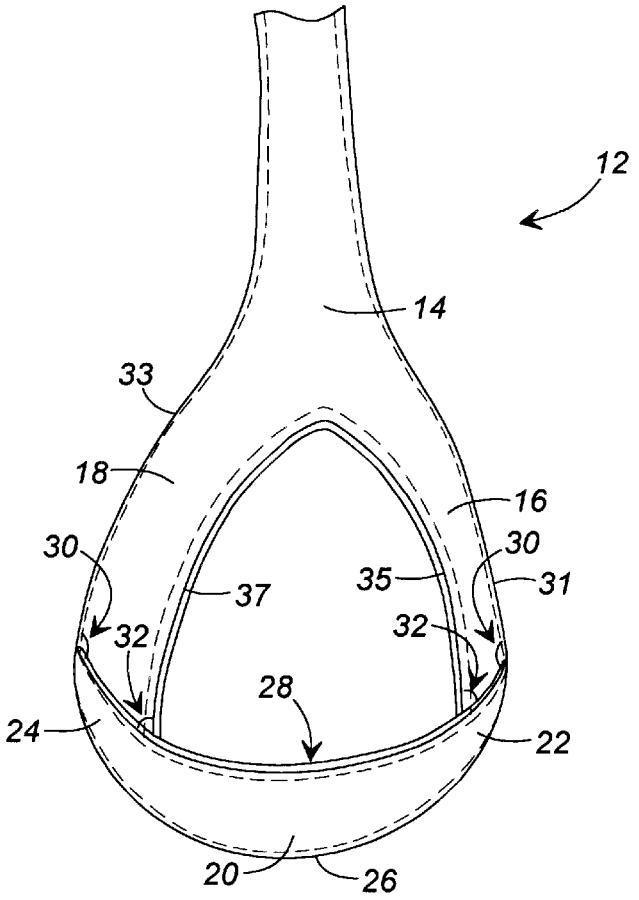
FIG. 1 is a front partial elevational view of a padded shaper attached to a partial cup.
Figure 2:
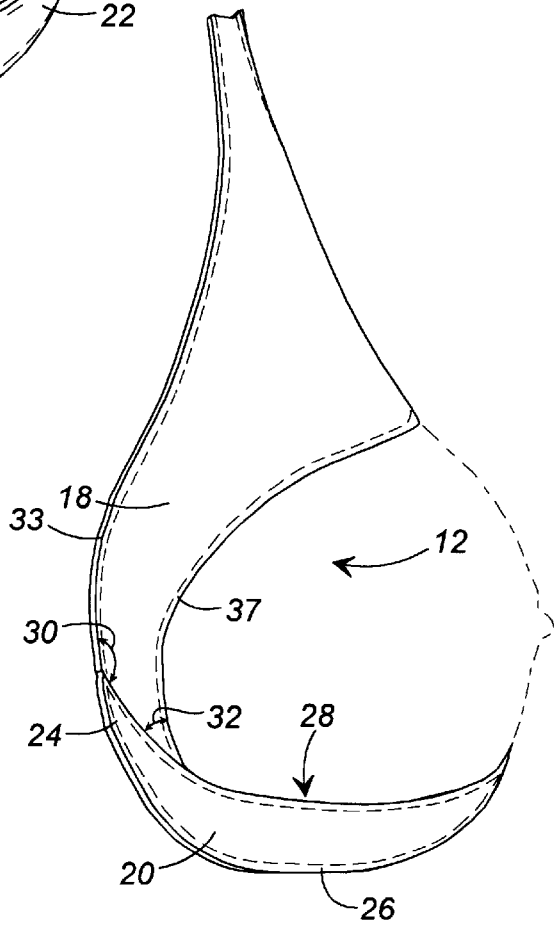
FIG. 2 is a side elevational view of the padded shaper attached to the partial cup.

Referring now to the figures, specific features of a wireless ergonomic support brassiere will be described. A particularly important feature of the bra is the padded shapers which are illustrated in FIGS. 1 and 2. The padded shaper 12 has a an inverted "Y" shape having an apex 14 and a medial leg 16 and a lateral leg 18 extending downwards from the apex 14. The medial and lateral legs 16 and 18 are positioned in order to extend downwards on either side of a breast. The padded shaper 12 is made out of soft, relatively non-elastic materials such as cotton and other materials known in the trade. In addition, the padded shaper is softly padded so that the padded shaper gently supports the breast.

Referring to FIGS. 3–7, the padded shaper also has a shoulder strap 50 which extends up from the apex, over the shoulder of the wearer. Accordingly, the padded shaper provides a lifting support from above the breast. Preferably, the medial and lateral legs 16 and 18 and the shoulder strap 50 are cut from a single piece of material, such that there are no seams to chafe and so that the maximum lifting force is achieved.

A partial cup 20 is attached to the medial and lateral legs 16 and 18 of the padded shaper 12. The partial cup has bottom 26, a central cup 28, a medial arm 22 extending from the central cup 28 which is attached to the medial leg 16 and a lateral arm 24 extending from an opposing side of the central cup 28 which is attached to the lateral leg 18. The partial cup 20 is designed to be placed underneath the breast and provides a foundation support from below the breast. The lateral arm 24 is attached to the lateral leg 18 at angles 30 and 32. Angle 30 may range from about 120 to about 140 degrees with respect to outer edges 31 and 33 and central cup 28 and angle 32 may range from about 65 to about 85 degrees with respect to inner edges 35 and 37 and central cup 28. The angles 30 and 32 are designed so that when the lateral arm 24 is attached to the lateral leg 18 and the medial arm 22 is attached to the medial leg 16, the greatest amount of lifting force is provided.

Like the padded shaper 12, the partial cup 20 is made from soft, relatively non-elastic materials such as cotton. Other materials known in the trade may also be used. In addition, the partial cup 20 can be gently padded so that the foundation support is comfortable and does not bind, chafe or cut like underwire or other stiff, unyielding support materials.

Figure 3:
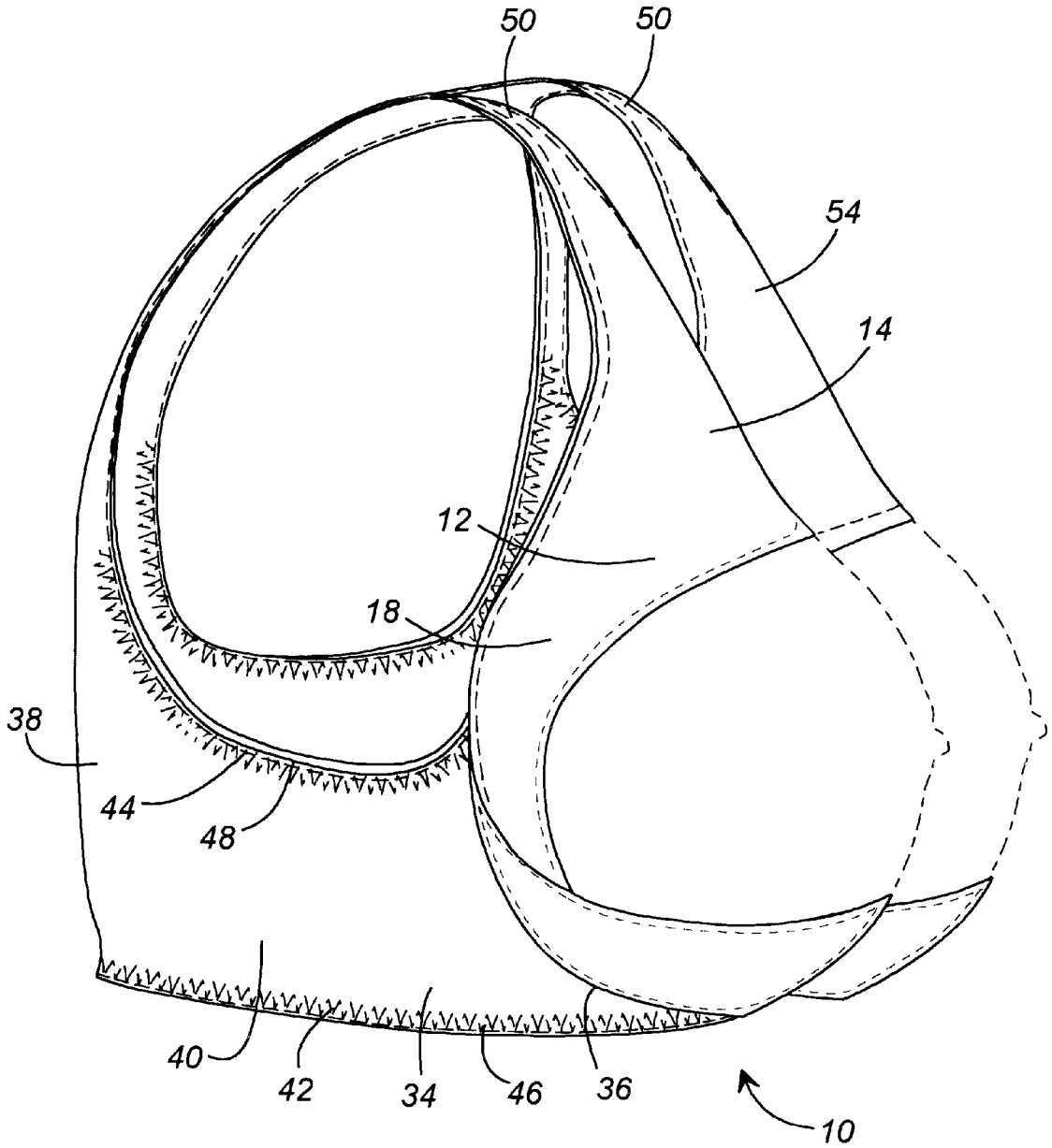
FIG. 3 is a side elevational view of the ergonomic support bra without closure means and without the outer covering.

Referring now to FIG. 3, the bra 10 contains a side portion 34 which is attached to the lateral leg 18 by seam 36. The side portion 34 integrates into a back portion 38. The integrated side portion 34 and back portion 38 combine to form a torso portion 40. The torso portion 40 wraps around the torso of the wearer and has a bottom edge 42 and a top edge 44. The torso portion 40 can be made out of any suitably soft, relatively non-elastic material such as the materials used to make the partial cup 20 and the padded shaper 12.

A band of soft elastic 46 may be attached to the bottom edge 42 of the torso portion 40 and the bottom 26 of the partial cup 20. The elastic band 46 gently holds the bra 10 in place against the torso of the wearer to prevent twisting and bunching of the bra 10. In addition, a top elastic band 48 may be attached to the top edge 44 of the torso portion 40. The elastic bands 46 and 48 do not function to provide any significant support for the breasts of the wearer.

A shoulder strap 50 extends upwards from the apex 14 of the padded shaper 12 over the shoulder of the wearer. The shoulder strap 50 connects to the back portion 38 at the top edge 44 of the torso portion 40. The shoulder strap 50 is preferably relatively wide, being from about ½ inch to about 1½ inches wide and may be padded to increase the comfort of the wearer.

In one embodiment, the torso portion 40 and the strap portion 50 can be integrated into a single shoulder/torso piece 54. The shoulder/back piece 54 can be formed from a single piece of soft material, again such as cotton and other materials known in the trade. In this embodiment, the bra 10 can be put on and taken off by slipping the bra 10 over the head of the wearer, similar to taking a shirt on and off.

Figure 4:
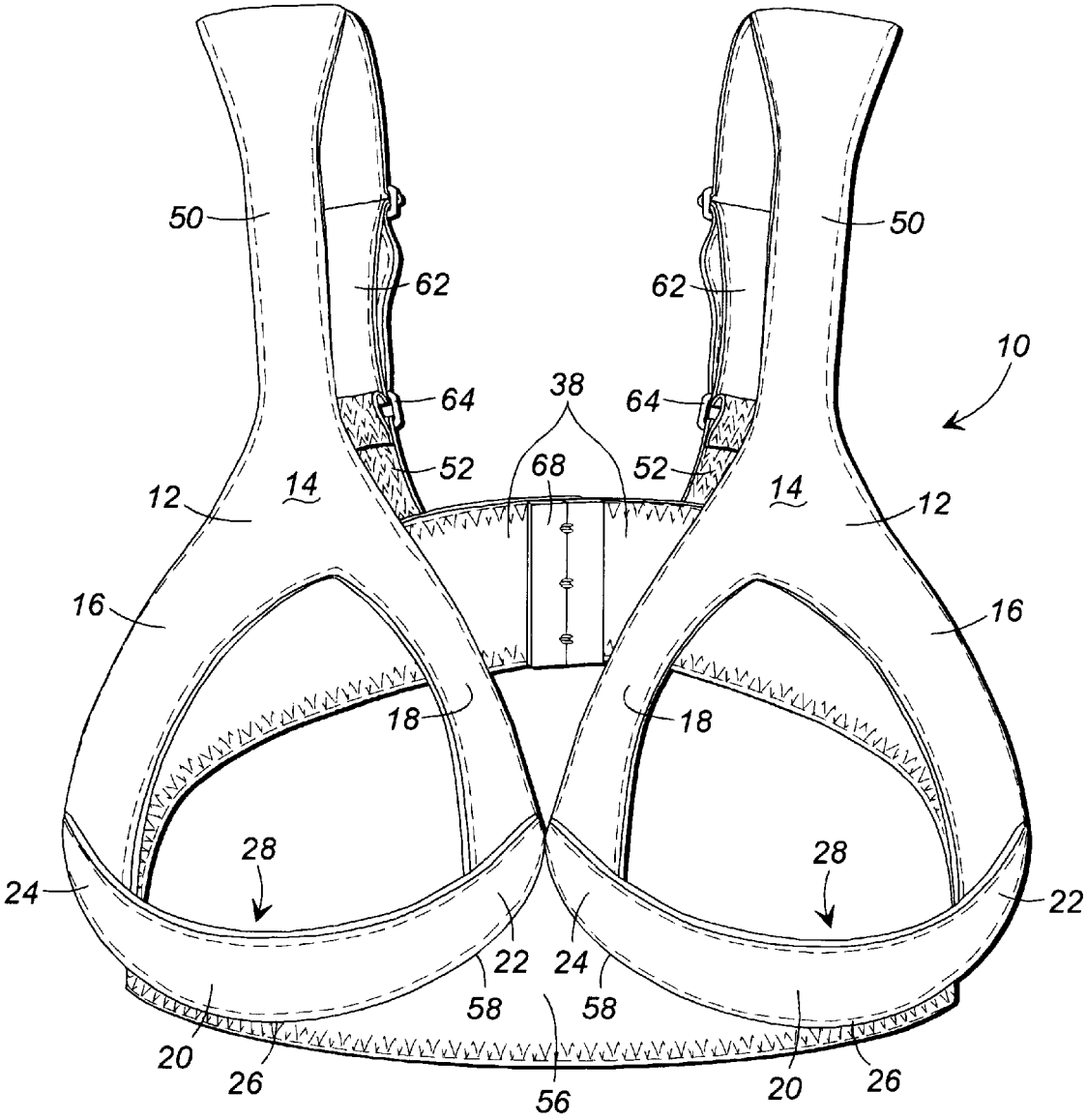
FIG. 4 is a front elevational view of the ergonomic support bra with front closure means and without an outer covering.

In another embodiment, the shoulder strap 50 may contain a portion of elastic 52 as shown in FIG. 4. When included, the elastic 52 is connected between the shoulder strap 50 and the top edge 44 of the torso portion 40. The elastic 52 can be included to provide for minimal amount of adjustment in the length of the shoulder strap 50. A minimal amount of strap adjustment may be necessary to compensate for variations in posture, especially for movement of the shoulders, arms, torso and neck of the wearer. The elastic 52 allows the shoulder strap 50 to gently move with the changing posture of the wearer without the wearer having to readjust the length of the shoulder strap 50 for optimal comfort and support.

The inclusion of the elastic 52 is especially beneficial during strenuous physical activities such as when the wearer participates in exercise or sports. The elastic 52 allows the wearer to move quickly and freely without losing comfort or support and without being bound into a single posture. The elastic 52 is also an important feature when the bra is worn as a nursing bra. In this embodiment, the elastic 52 allows for minimal adjustments in the length of the shoulder strap to compensate for the changing breast size of the nursing mother. Additionally, as can be seen, the bra 10 can contain a middle portion 56 which is connected to medial legs 22 by seam 58.

In an alternative embodiment, the middle portion 56 may be comprised of a single piece of material, such as the materials used for the padded shapers 12 and the partial cups 20. In this embodiment, a back closure means 68 are usually provided. The back closure means 68 can be comprised of any closure means known in the trade, for example, such as hook and eye closures, snap closures and hoop and loop material.

Figure 5:
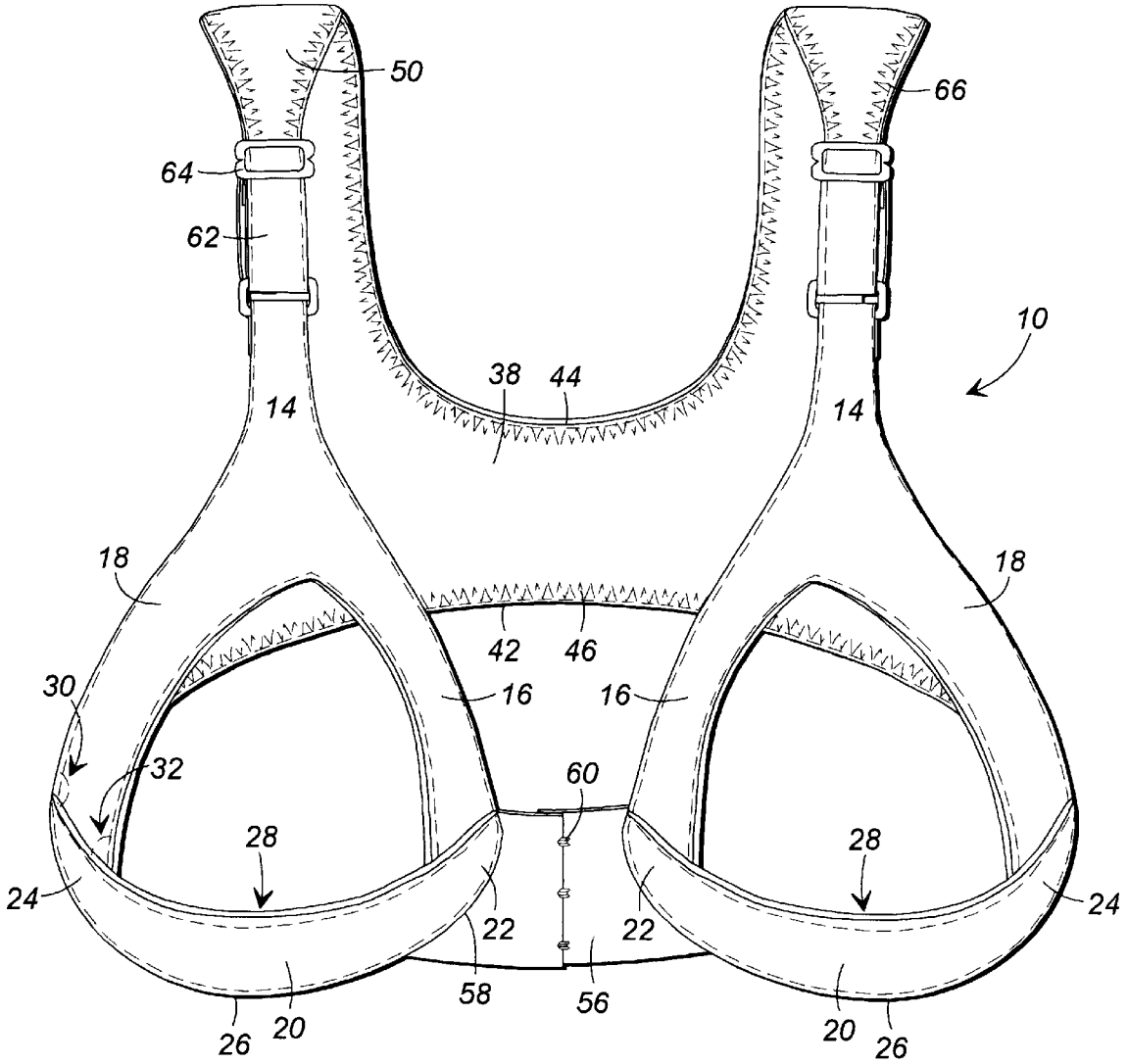
FIG. 5 is a front elevational view of a ergonomic support bra with back closure means and without an outer covering.

Referring to FIG. 5, as an alternative embodiment, the middle portion 56 can contain front closure means 60. Front closure means can be snaps, hoop and loop material, hook and eye material or other closure means known in the trade.

In another embodiment, a short piece of adjustable strap 62 along with adjustment means 64 can be placed at some portion along the length of strap 50 between the apex 14 and the top of the torso portion 44. By including an adjustable strap 62, the wearer can customize the fit of the bra 10. If the wearer experiences fluctuations in the amount of support required, for instance during times of weight gain or loss, the wearer can adjust the adjustable strap 62 to compensate for such changes. In addition, because not all women are of the same shape, size or height, adjustable strap 62 allows the bra 10 to be worn by a variety of women. Each individual woman can customize the fit of bra 10 by adjusting adjustable strap 62 until optimal support and comfort are achieved.

In an additional embodiment a light stretchable material 66, such as elastic can be attached along the strap 50 and the top of the torso portion 44 so that the bra 10 fits gently against the shoulders and torso of the wearer. Like elastic portions 46 and 48, the material 66 does not provide any significant support function.

Figure 6:
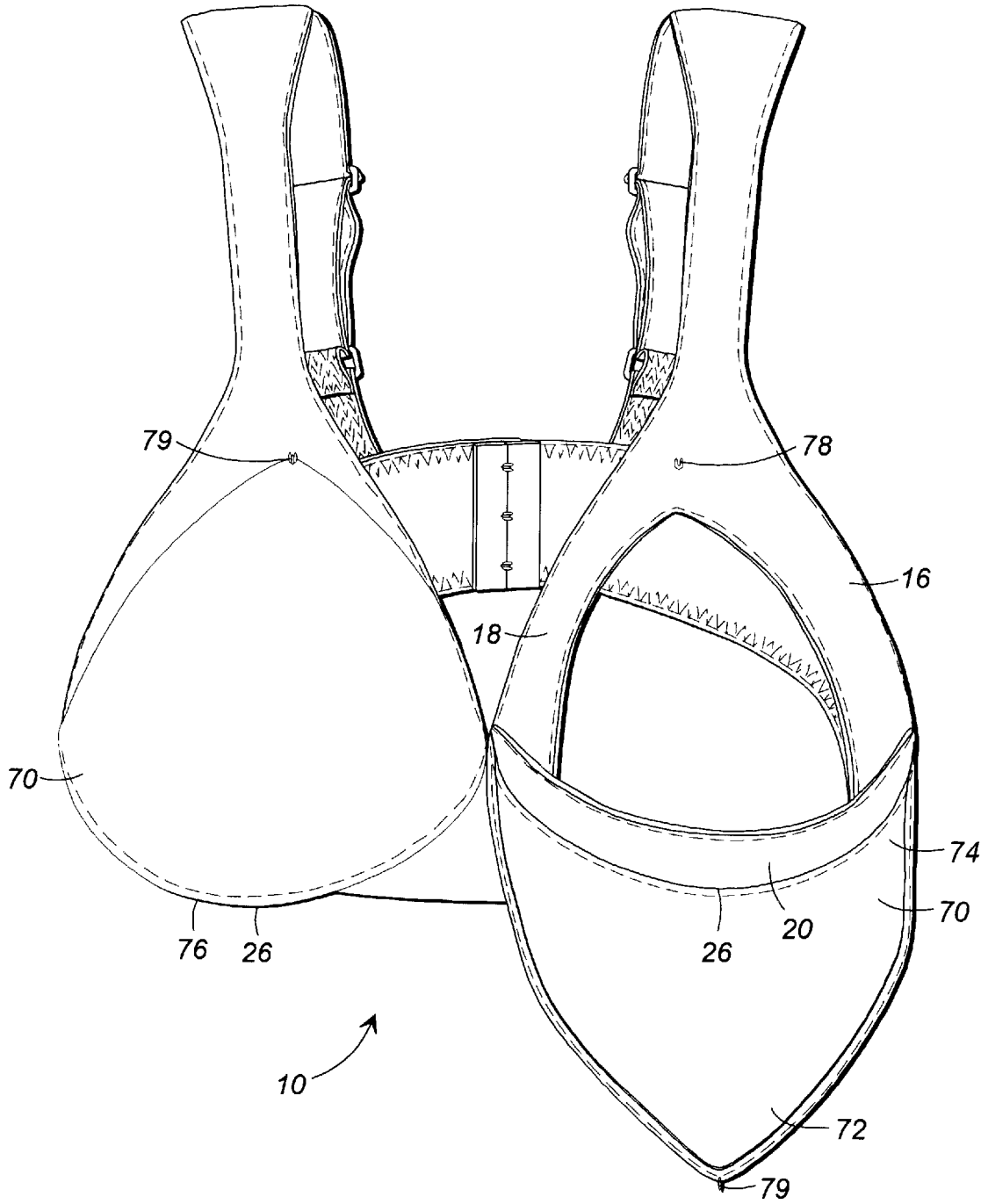
FIG. 6 is a front elevational view of the ergonomic support bra with an outer covering which removably attaches to the padded shaper.

Referring now to FIG. 6, a folding outer cup 70 may be attached to the bra 10 at the bottom 26 of the partial cup 20. Again, the folding outer cup 70 can be composed of any suitable soft, flexible material, such as cotton and other materials known in the trade. The outer cup 70 has a top 72 and a bottom 74. The bottom 74 of the folding outer cup 70 is attached to the partial cup 20 by seam 76. By placing the seam 76 at the bottom 26 of the partial cup 20, the outer cup 70 can be folded down to completely expose the breast, providing access to the woman's nipple. The outer cup 70 is attached to the bra 10 by closure means 78 and 79 at the apex 14 and at the top 72 of the folding cup 70. The closure means 78 can be comprised of any closure means known in the trade including for example, snaps, hook and eye closures, hoop and loop material and others. The folding outer cup 70 does not provide any substantial support. By providing the folding outer cup 70, an outer covering can be displaced to expose a woman's nipple, such as for nursing, without having to remove the entire bra 10.

Figure 7:
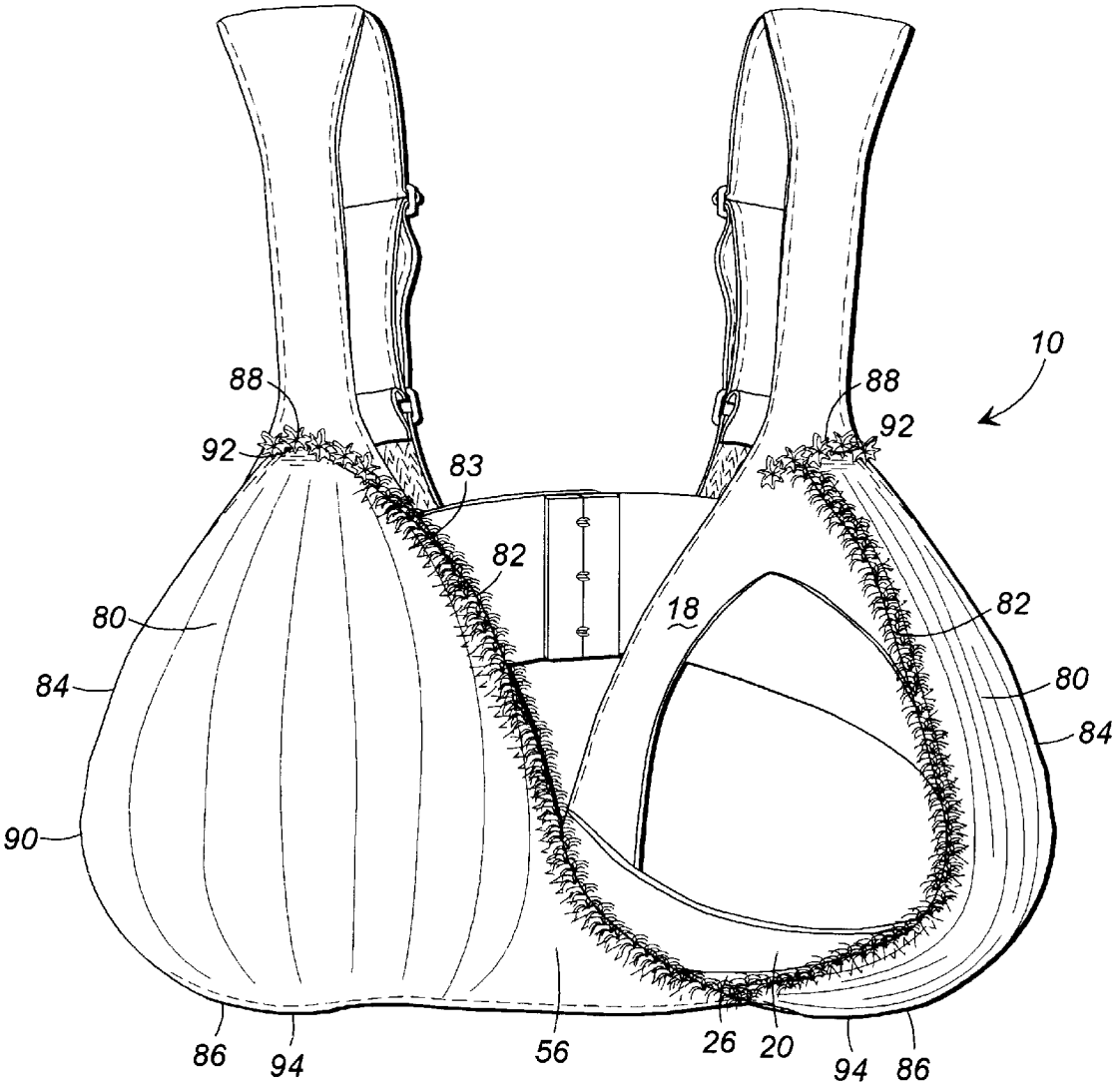
FIG. 7 is a front elevational view of the ergonomic support bra with an outer covering which stretches to the side.

Alternatively, referring now to FIG. 7, a stretchable outer cup 80 may be provided for the bra 10. The stretchable outer cup 80 is basically triangular in shape. The stretchable outer cup 80 has a long medial side 82, a lateral side 84, a bottom side 86 and a top side 88. The stretchable outer cup 80 can be composed of any suitable, stretchable material, such as a stretching cotton, stretch lace and other materials known in the trade. The lateral side 84 of the outer cup 80 can be attached to the lateral leg 18 of the padded shaper 12 by seam 90. The top side 88 of the outer cup 80 is at least partially attached to the apex 14 of the padded shaper by seam 92. The bottom side 86 is attached to the bottom 26 of the partial cup 20 and to at least a portion of the medial portion 56 by seam 94. The medial side 82 of the outer cup 80 is not attached to the medial leg 16 of the padded shaper 12. Thus, the wearer can grasp the medial side 82 of the outer cup 80 and pull the cup 80 towards the lateral side 84 of the stretchable cup 80. By pulling the medial side 82 towards the lateral side 84, the nipple of the breast is exposed, without having to remove the bra 10. The medial side 82 may have a thin elastic portion 83 attached along its outer edge. The elastic portion prevents twisting and bunching of the stretchable outer cup 80. The elastic portion 83 does not provide any support function. Alternatively, both the lateral side 84 and the medial side 82 are unattached. This is especially beneficial for nursing mothers.

In yet another embodiment, the outer cups 70 or 80 can be completely attached to the padded shaper 12 and the partial cup 20 such that the outer cups do not fold down or stretch to reveal a woman's breast. This embodiment is provided when the bra 10 is not to be used for nursing applications.

Various portions of the bra 10 may be made from a variety of materials customarily used for such applications. However, it is particularly preferred to make the bra 10 substantially out of a hypo-allergenic material such as cotton.

While specific embodiments of the invention have been described with particularity above, it will be appreciated that the invention is capable of numerous rearrangements and substitutions by those of ordinary skill in the art without departing from the scope of the invention.

What is claimed is:

1. A bra which comprises:

padded shapers for lifting a breast, each shaper being in the form of an inverted "Y" having a medial leg portion and a lateral leg portion and a shoulder portion at the apex of the inverted "Y" wherein the medial leg portion and the lateral leg portion of each shaper extend downward from the apex on either side of the breast of a wearer to provide lifting support from above the breast when the bra is being used;

padded, partial cup portions each having a lateral arm portion attached to the lateral leg portion and a medial arm portion attached to the medial leg portion of said shapers thereby forming a central cup portion between the lateral and medial arm portions of said cup portions for supporting the breast from below the breast during use, wherein the lateral arm portion is attached along at least a portion of its length to the lateral leg portion and the medial arm portion is attached along at least a portion of its length to the medial leg portion;

a middle portion connected between the cup portions to the medial arm portions of said cup portions;

a torso portion having a bottom, side portions and a back portion wherein the side portions are connected to the lateral arm portions of the cup portions and the back portion extends from between the side portions around a torso of the wearer, the back portion having a top edge; and shoulder straps connected to the top edge of said back portion wherein said straps extend over a wearer's shoulders when the bra is in use and said straps are connected to said shoulder portions of said shapers.

2. The bra according to claim 1 wherein the medial leg portion, the lateral leg portion and the shoulder strap are all are comprised of a single piece of material.

3. The bra according to claim 1 wherein the shoulder portions and shoulder straps have a width ranging from about ½ inches to about 1½ inches wide.

4. The bra according to claim 1 further comprising a closure means located in the back portion of the bra.

5. The bra according to claim 1 further comprising strap adjustment means included on the shoulder straps to provide adjustment of the length of the shoulder straps on the wearer.

6. The bra according to claim 1 wherein a portion of elastic material is provided between the shoulder strap portion and the back portion of the torso portion.

7. The bra according to claim 1 wherein lateral arm of the partial cup attaches to one side of the lateral leg of the padded shaper at an angle ranging from about 65 to about 85 degrees and to an opposing side of the lateral shaper at an angle ranging from about 120 to about 140 degrees.

8. The bra according to claim 1 wherein the torso portion, the shoulder portions and the shoulder straps are comprised of a single piece of material.

9. The bra according to claim 8 further comprising a closure means located in the middle portion of the bra.

10. The bra according to claim 8 further comprising soft, stretchable elastic located around the torso portion, to provide a gentle fit to the wearer.

11. The bra according to claim 1 further comprising a closure means located in the middle portion of the bra.

12. The bra according to claim 1 further comprising an outer covering portion, basically triangular in shape, which extends from the apex of the padded shapers to the bottom, medial and lateral arms of the cup portion and provides a cover for the breast.

13. The bra according to claim 12 wherein the outer cup portion is comprised of stretchable, soft fabric.

14. The bra according to claim 12 wherein the outer covering comprises a bottom portion which is attached to the bottom of the partial cup portion and a top portion which is removably attached to the apex of the padded shaper by standard closure means.

15. The bra according to claim 12 wherein the outer cup portion is fixedly attached at to the apex of the padded shaper and to the bottom of the partial cup portion, so that the outer cup portion can be stretched away from the breast.

16. The bra according to claim 1 further comprising an elastic rib-cage band connected to the bottom of the cup portion and the bottom of the torso portion to prevent twisting of the bra.

17. The bra according to claim 1 wherein the bra is comprised entirely of cotton material to provide a hypo-allergenic garment.

18. A lifting and support device for a foundation garment which comprises an inverted Y-shaped portion having an apex, a lateral side and a medial side attached to a support means having a bottom portion, a lateral arm and a medial arm for uplifting support of a woman's breast wherein the lateral side of the Y-shaped portion is connected to the lateral arm at an angle ranging from about 120 to about 140 degrees therebetween and the medial side is attached to the medial arm at an angle ranging from about 65 to about 85 degrees therebetween.

19. The lifting and support device of claim 18 wherein the support means comprises a padded cup.

20. The lifting and support device of claim 19 wherein the support means and Y-shaped portion are comprised of hypo-allergenic materials.

21. The lifting and support device of claim 18 further comprising an outer covering portion, basically triangular in shape, which extends from the apex of Y-shaped portion to the bottom portion of the support means thereby providing a cover for the breast.

22. The lifting and support device of claim 21 wherein the outer covering portion is comprised of stretchable, soft fabric.

* * * * *